US006367753B1

(12) United States Patent
Berg

(10) Patent No.: US 6,367,753 B1
(45) Date of Patent: Apr. 9, 2002

(54) PONY TANK QUICK RELEASE

(76) Inventor: Daniel T. Berg, 2745 Cheshire Dr., Baldwin, NY (US) 11510

( * ) Notice: Subject to any disclaimer, the term of this patent is extended or adjusted under 35 U.S.C. 154(b) by 0 days.

(21) Appl. No.: 09/885,159

(22) Filed: Jun. 21, 2001

(51) Int. Cl.[7] ..... A47B 96/00

(52) U.S. Cl. ..... 248/222.11; 248/223.31; 248/223.41; 248/295.11; 248/313; 224/250; 224/934

(58) Field of Search ..... 248/223.31, 295.11, 248/230.8, 223.41, 230.9, 219.4, 222.11, 313, 297.21; 224/250, 934

(56) References Cited

U.S. PATENT DOCUMENTS 4,949,889 A * 8/1990 Carson
5,199,820 A * 4/1993 Nicklo
5,390,886 A * 2/1995 Lawner et al.
5,579,967 A * 12/1996 Berg
5,906,302 A * 5/1999 Spergel

* cited by examiner

*Primary Examiner*—Kimberly T. Wood
*Assistant Examiner*—Korie Chan
(74) *Attorney, Agent, or Firm*—Myron Amer PC

(57) ABSTRACT

An assembly of a slide to a bracket which effectuates engagement of a pony tank to a main tank of scuba diving equipment in which the assembly is achieved under spring urgency, and wherein to disengage the two tanks all that is required is finger pressure applied in opposition to the spring urgency which contributes to rapidity in the disengagement or a quick release of the pony tank from the main tank.

1 Claim, 1 Drawing Sheet

PONY TANK QUICK RELEASE

The present invention relates generally to improvements in scuba diving equipment, and more particularly to achieving attachment of a pony tank to a main air supply tank to such an extent as to obviate inadvertent unattachment therebetween, but without undermining the ability to effectuate quick release of the pony tank from the main tank should circumstances warrant doing so.

EXAMPLES OF THE PRIOR ART

The practice in scuba diving is well documented in prior patents of supplementing the air supply of the diver using a so-called pony tank attached to the main tank, as exemplified by U.S. Pat. No. 5,390,886 for "Scuba Accessory Interchange System" issued to Lawner et al. on Feb. 21, 1995 and U.S. Pat. No. 5,906,302 for "Scuba Tank Mounting Mechanism" issued to Spergel on May 25, 1999, to mention but a few.

In the '886 patent, cooperating male and female brackets provide the attaching function and a separate mechanism appertainment to the female bracket has to be disengaged to provide the disengaging function, and in the '302 patent, brackets are similarly used to provide the attaching function, and the removal of clamps is involved in effectuating disengagement of the pony tank. In these, and all other known patents, the attaching and unattaching functions are, of course, provided, but the latter or unattaching function is not achieved with any noteworthy rapidity, as would result, for example, with a simplified operating mode such as an applied finger pressure. Yet, a quick release of the main tank/pony tank assembly is often desirable in emergency and other circumstances.

Broadly, it is an object of the present invention to provide a quick release of the two tank assembly overcoming the foregoing and other shortcomings of the prior art.

More particularly, it is an object to effectuate engagement of the pony tank to the main tank under spring urgency, and to disengage the two tanks with finger pressure applied in opposition to the spring urgency to contribute to rapidity in the disengagement, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit appended claims.

Scuba equipment typically includes a main compressed air supply tank 10 on which there is attached a supplementary compressed air supply in a smaller tank 12 known in the parlance of the sport as a pony tank. In scuba diving, an entry maneuver is sometimes utilized by the diver and during this maneuver, forces are impacted against the main and pony tanks that require that the attachment of the pony tank to the main tank must be of an extent that obviates inadvertent detachment of the pony tank from the main tank. Additionally, during scuba diving, the diver might typically assume an upside down position which again necessitates that there not be any inadvertent detachment of the pony tank from the main tank. Yet, it is necessary that if circumstances require, that the diver or a companion be able to quickly disconnect the pony tank 12 from the main tank 10.

Figure 4:
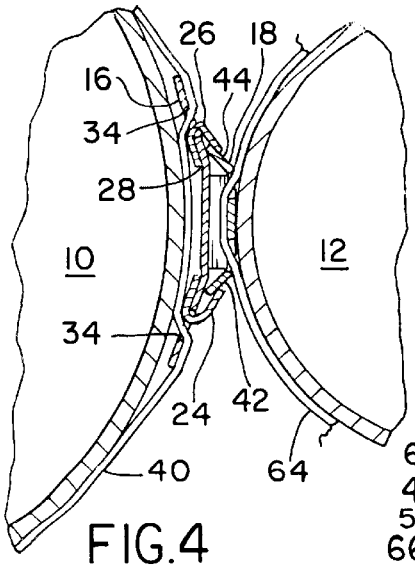
FIG. 4 is a partial view, on an enlarged scale, as taken along line 4—4 of FIG. 1.
Figure 3:
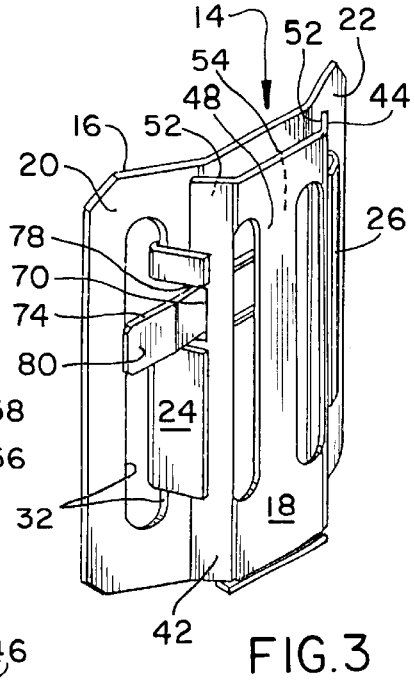
FIG. 3 is a view of quick release components of FIG. 2 but in assembled condition.
Figure 1:
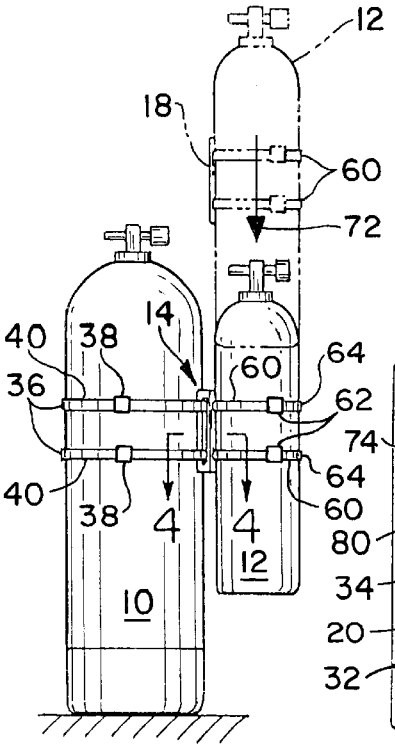
FIG. 1 is a side elevational view of a scuba main air supply tank on which there is attached a pony air supply tank using in their attachment together a quick release in accordance with the present invention.
Figure 2:
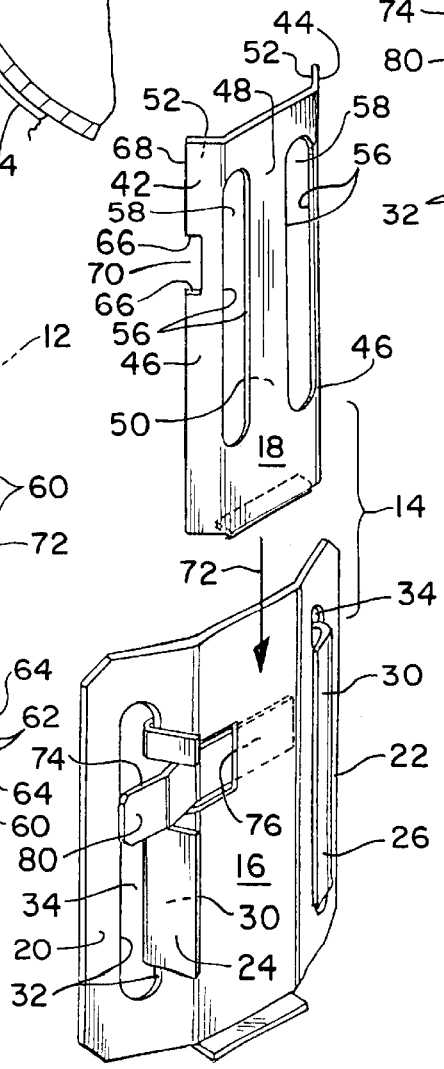
FIG. 2 is an isolated perspective view of the components of the quick release in unassembled condition.

Satisfying the two requirements of a firm interconnection and an emergency or otherwise quick disconnection or release is the two-component quick release of the present invention, generally designated 14, as shown in unassembled condition in FIG. 2 and in its assembled condition in FIG. 3, the one component being a bracket, generally designated 16, and the other component being a slide, generally designated 18.

Bracket 16 has opposite angular oriented spaced apart sides 20 and 22 having opposing curved walls 24 and 26 in facing relation to each appropriately attached, as by welding, as at 28, presenting inboard surfaces 30 serving as tracking guides. A cooperating pair of edges 32 in a central location on each bracket side 20, 22 bound a cooperating first pair of spaced apart notches 34 through which a first pair of straps 36 each having interconnecting buckle means at their ends 38 are provided with operative positions disposed in threaded relation through the notches 34 to form closed loops 40 in encircling gripping engagement about the main air supply tank 10 incident to the connection together of the straps 36 opposite ends 38.

Turning now to the slide component 18, it likewise has opposite angular oriented sides 42 and 44 presenting outer surfaces 46 serving as tracking surfaces and includes a medial portion 48 connected in spanning relation between the opposite sides 42, 44 and the undersurface or rear surface 50 of medial portion 48 cooperates with inboard surfaces 52 of the slide sides 42, 44 to bound a strap compartment 54. Edges 56 in a central location on each side 42, 44 bounds a cooperating second pair of spaced apart notches 58 and a second pair of straps 60 having interconnecting buckle mean at their ends, as at 62, are provided with operative positions disposed in threaded relation through a first encountered notch 58, through the strap compartment 54, and through the second encountered notch 58 to form closed loops 64 in encircling gripping engagement about the pony tank 12 incident to the connection together of the second straps 60 opposite ends 62.

Edges 66 at a selected location along an edge 68 of a slide side 42 cooperate to bound an open ended tracking stop 70, such that an operative sliding position of movement of the slide 18 in directional movement 72 of the track surfaces 46 in tracking relation along the bracket track guides 30 can effectuate interconnection of the slide 18 to the bracket 16. This is achieved using a stop 74 of springy construction material which extends transversely from a welded or other appropriate site of connection 76 from the bracket 16 into the path of tracking movement 72 so as to snap into engagement, as at 78, with the track stop 70. In this manner the slide 18 and bracket 16 are firmly interconnected, but finger pressure applied against a free end 80 of the stop 74 is effective to cause the quick release or disengagement of the slide 18 from the bracket 16 permitting opposite direction movement of the slide 18 and thus of the pony tank 12 from the main tank 10.

While the quick release herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A quick release from a scuba main air supply tank for a pony air supply tank attached thereto comprising; (a) a bracket, opposite angular oriented spaced apart sides on said bracket having curved walls presenting inboard surfaces serving as tracking guides, edges in a central location on each of said bracket sides bounding a cooperating first pair of spaced apart notches, a first pair of straps having interconnecting opposite ends having operative positions disposed in threaded relation through said first pair of notches and forming closed loops in encircling gripping engagement about said main air supply tank incident to a connection together of said first straps opposite ends; (b) a slide, opposite angular oriented sides on said slide presenting outer surfaces serving as tracking surfaces, a medial portion of said slide connected in spanning relation between said opposite sides of said slide having a rear surface cooperating with inboard surfaces of said sides of said slide to bound a strap compartment, edges in a central location on each of said sides of said slide bounding a cooperating second pair of spaced apart notches, a second pair of straps having interconnecting opposite ends having operative positions disposed in threaded relation through a first notch of said second pair of notches and through said strap compartment and through said other notch of said second pair of notches and forming closed loops in encircling gripping engagement about said pony air supply tank incident to a connection together of said second straps opposite ends, edges at a selected location along an edge of a side of said slide cooperating to bound an open ended tracking stop, said tracking surfaces of said slide slidably received in said tracking guides of said bracket to define a path of tracking movement, and a stop of springy construction material extending from said bracket transversely of said path of tracking movement so as to snap into engagement within said track stop, whereby finger pressure applied against a free end of said stop is effective to cause the disengagement thereof out of said tracking stop and opposite direction movement of said slide resulting in a quick release of said pony tank from said main tank.

* * * * *